US006225906B1

(12) United States Patent
Shore

(10) Patent No.: US 6,225,906 B1
(45) Date of Patent: May 1, 2001

(54) PATIENT MONITORING AND ALARM SYSTEM

(76) Inventor: Bernard Shore, 175-10 65th Ave., Flushing, NY (US) 11365

( * ) Notice: Subject to any disclaimer, the term of this patent is extended or adjusted under 35 U.S.C. 154(b) by 0 days.

(21) Appl. No.: 09/535,467

(22) Filed: Mar. 26, 2000

(51) Int. Cl.[7] ..... G08B 23/00

(52) U.S. Cl. ..... 340/573.4; 340/10.5; 340/10.51; 340/10.52; 340/573.1

(58) Field of Search ..... 340/573.4, 10.5, 340/10.51, 10.52, 572.2; 700/17, 83; 235/383, 385, 384

(56) References Cited

U.S. PATENT DOCUMENTS 4,837,568 * 6/1989 Snaper ..... 340/825.54
5,117,222 * 5/1992 McCurdy et al. ..... 340/573
5,295,062 * 3/1994 Fukushima ..... 364/188
5,347,628 * 9/1994 Brewer et al. ..... 395/159
5,396,227 * 3/1995 Carroll et al. ..... 340/825.31
5,512,879 * 4/1996 Stokes ..... 340/573
5,525,969 * 6/1996 LaDue ..... 340/573
5,652,570 * 7/1997 Lepkoofker ..... 340/573
6,002,401 * 12/1999 Baker ..... 345/349

* cited by examiner

*Primary Examiner*—Jeffery Hofsass
*Assistant Examiner*—Son Tang
(74) *Attorney, Agent, or Firm*—Michael I Kroll

(57) ABSTRACT

A system for monitoring tagged objects within a predefined area provides a user-friendly interactive interface for monitoring tagged objects in a predetermined area. The method of providing the user interface includes the steps of entering security information permitting users access to the interface, generating a first menu tool bar on a screen for initiating a plurality of functions and initiating a function selected from the first menu toolbar. The plurality of functions able to be initiated from he toolbar include at least two of monitoring a status of alarms on tags, associating a uniquely identified tag with an individual object, updating tag information, updating object identification information, and disabling tag monitoring system for a selected tag. The toolbar includes a plurality of icons, each of said icons representing a respective one of the plurality of functions. Selection of any one of the icons generates an display screen specific to the function selected.

21 Claims, 15 Drawing Sheets

OVERALL OF ENTIRE PROGRAM

TIMER AND TRACKING
(TRANSPORT)

PATIENT MONITORING AND ALARM SYSTEM

BACKGROUND OF THE INVENTION

1. Field of the Invention

The present invention relates generally to tag monitoring systems and, more specifically, to a user friendly interactive remotely controlled computer system for monitoring a tag attached to a patient or object and generating an alarm when the tag is carried outside a predetermined unauthorized area or the tag has been cut for removal from the person or object.

2. Description of the Prior Art

Numerous other tracking and monitoring systems used for locating items within a designated area and generating an alarm signal when the items leave or are carried out of the designated area are provided in the prior art. Such systems include tag alarms placed on merchandise which must be disabled at the retail store registers.

Security access systems installed in doorways which require a user to key-in a combination code or pass an ID badge through a card reader are also provided in the prior art for monitoring the location of an item. Additionally, security and surveillance systems using a processor to generate a signal that is transmitted to perform task specific functions such as locking down of a site have also been developed for similar purposes.

While these systems may be suitable for the purposes for which they were designed, none provide all the unique features of the present invention. Therefore, they would not be as suitable for the purposes of the present invention, as hereinafter described.

SUMMARY OF THE PRESENT INVENTION

The present invention relates generally to tag monitoring systems and, more specifically, to a user friendly interactive remotely controlled computer system for monitoring a tag attached to a patient or object and generating an alarm when the tag is carried outside a predetermined unauthorized area or the tag has been cut for removal from the person or object.

A primary object of the present invention is to provide a patient monitoring and alarm system that will overcome the shortcomings of prior art devices.

A further object of the present invention is to provide a patient monitoring and alarm system which is able to assign a tag to a patient upon admission to a health care facility and monitor the location of the patient while within the facility and until such time as the patient is discharged from the facility.

An even further object of the present invention is to provide a patient monitoring and alarm system able to protect patients from abduction by signaling authorized personnel upon detecting the patient is being taken from a designated area.

A still further object of the present invention is to provide a patient monitoring and alarm system able to prevent the substitution of identification from one patient to another, as in the case of swapping the tags of newborns.

A yet further object of the present invention is to provide a patient monitoring and alarm system which is able to alert authorized personnel when an attempt is being made to disable or remove the tag from a patient.

Another object of the present invention is to provide a patient monitoring and alarm system which is able to passively monitor a patient using strategically located sensors which will report movement of tagged patients authorized personnel.

A still further object of the present invention is to provide a patient monitoring and alarm system having a plurality of remote sensors able to transmit radio frequency signals to a central processing station, the central processing station recording and reporting the movement of a tagged patient within a health care facility to authorized personnel.

Another object of the present invention is to provide a patient monitoring and alarm system including one or more user-friendly interactive central stations each having a monitor, a keyboard, a card reader, a transmitter, a receiver and a printer for reporting, displaying and editing data through the use of graphical user interfaces and capable of displaying a location of an alarm condition on a floor plan or floor plans of the facility.

Yet another object of the present invention is to provide a patient monitoring and alarm system whereby a tag can be assigned to a patient for monitoring purposes.

An even further object of the present invention is to provide a patient monitoring and alarm system able to generate real time alarms and reports to thereby prevent unauthorized tampering or removal of a tag from the patient.

A yet further object of the present invention is to provide a patient monitoring and alarm system wherein a plurality of sensors are positioned throughout a health care facility acting in concert with the tag of a patient to generate a record and, upon detection of certain predetermined conditions, causing an alarm signal to be generated.

A still further object of the present invention is to provide a patient monitoring and alarm system wherein staff and/or security personnel are able to disengage the system for a predetermined period of time in order to adjust the tag without causing the alarm signal to be generated.

Yet another object of the present invention is to provide a patient monitoring and alarm system able to allow movement of a tagged patient from one location to another outside of a predetermined range of motion for a predetermined period of time whereby a return time for the patient is monitored and an alarm signal is generated upon expiration of the predetermined period of time or if the patient deviates from a path to be followed to a predetermined destination.

Another object of the present invention is to provide a patient monitoring and alarm system including security access functions whereby a user must have an ID badge and/or password to access the system.

Yet another object of the present invention is to provide a patient monitoring and alarm system which will deter individuals from criminal acts by its very presence and provide a comfort factor to the staff and patrons of the facility.

Another object of the present invention is to provide a patient monitoring and alarm system that is simple and easy to use.

A still further object of the present invention is to provide a patient monitoring and alarm system that is economical in cost to manufacture.

Additional objects of the present invention will appear as the description proceeds.

A system for monitoring tagged objects within a predefined area provides a user-friendly interactive interface for monitoring tagged objects in a predetermined area is disclosed by the present invention. The method of providing the user interface includes the steps of entering security information permitting users access to the interface, generating a first menu tool bar on a screen for initiating a plurality of functions and initiating a function selected from the first menu toolbar. The plurality of functions able to be initiated from the toolbar include at least two of monitoring a status of alarms on tags, associating a uniquely identified tag with an individual object, updating tag information, updating object identification information, and disabling tag monitoring system for a selected tag. The toolbar includes a plurality of icons, each of said icons representing a respective one of the plurality of functions. Selection of any one of the icons generates an display screen specific to the function selected.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 10:
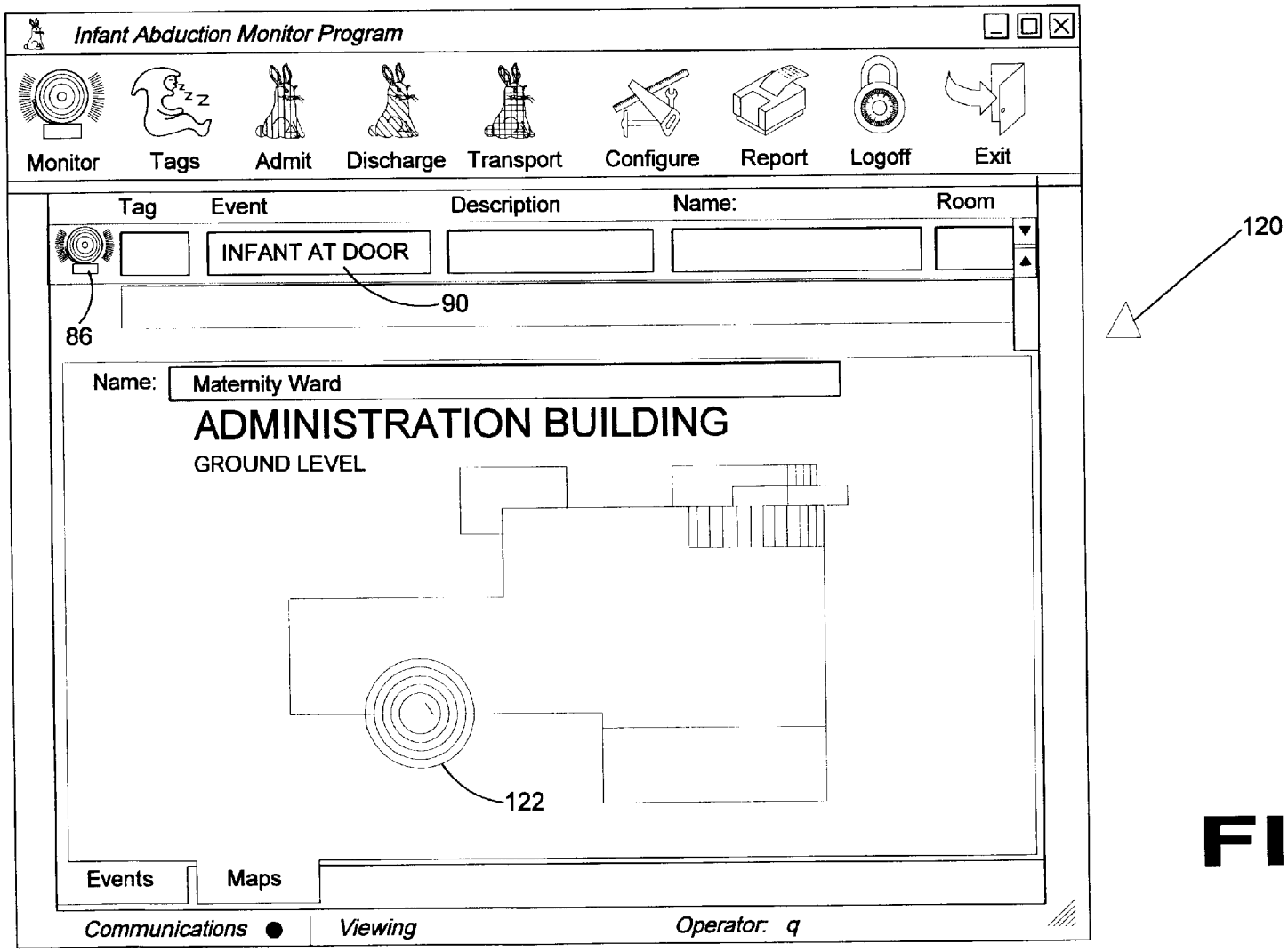
Figure 11:
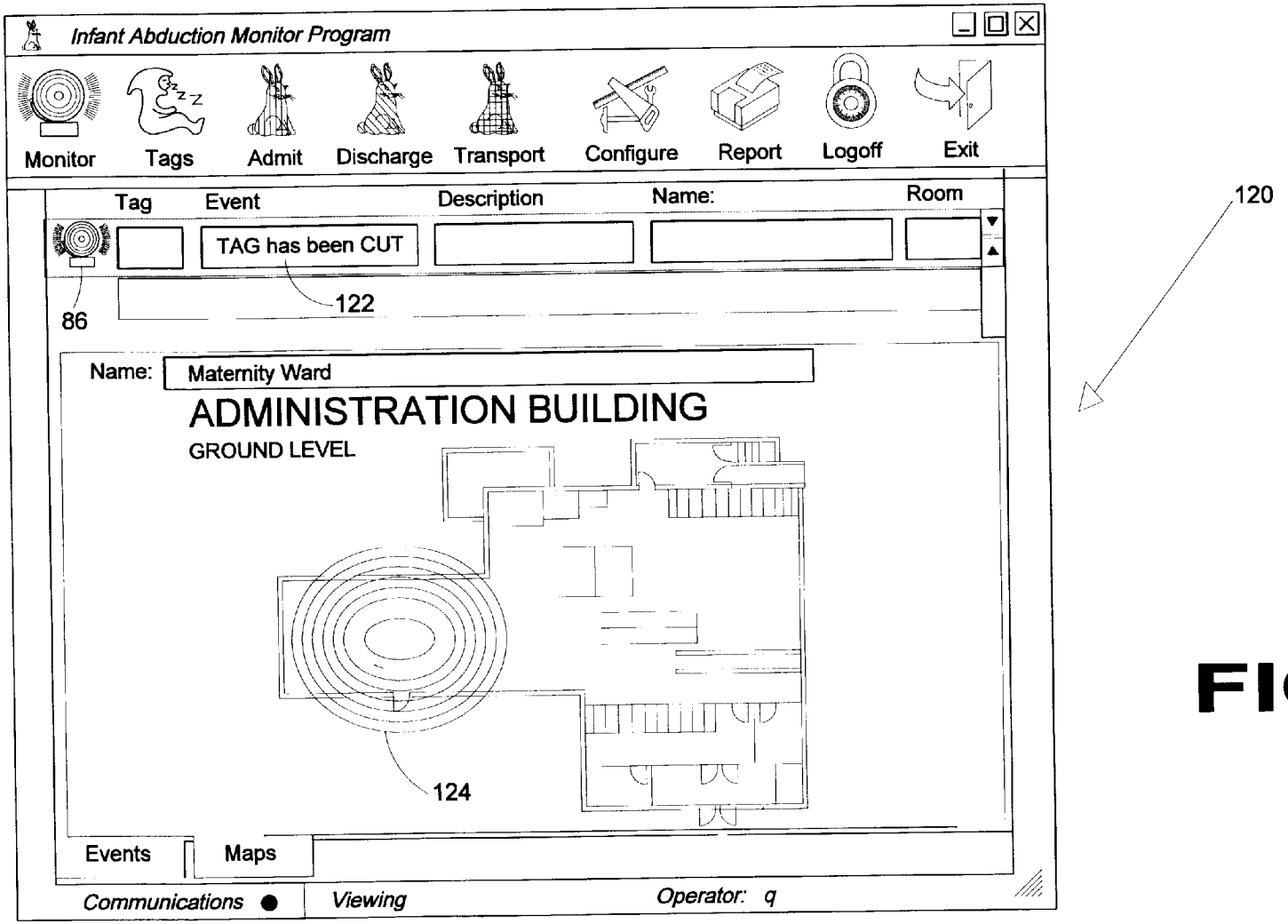

FIG. 10 is a diagrammatic view of a typical floor plan displayed by the patient monitoring and alarm system of the present invention, displaying an alarm condition caused by a patient entering within sensor range of an egress door; and FIG. 11 is an illustrative view of another typical floor plan of the patient monitoring and alarm system of the present invention which can be selectively displayed.

DESCRIPTION OF THE REFERENCED NUMERALS

Turning now descriptively to the drawings, in which similar reference characters denote similar elements throughout the several views, the Figures illustrate the patient monitoring and alarm system of the present invention. With regard to the reference numerals used, the following numbering is used throughout the various drawing figures.

10 patient monitoring and alarm system of the present invention
12 facility in which patient monitoring and alarm system is installed
14 central monitoring station
16 plurality of sensors
18 tag
20 person or object
22 central processor
24 monitor
26 transmitter/receiver
28 tag/barcode reader
30 keyboard
32 mouse
34 printer
36 processor of tag
37 power source of tag
38 memory of tag
39 receiver of tag
40 transmitter of tag
41 audible and visual indicators of tag
42 memory of sensor
44 processor of sensor
45 power source of sensor
46 receiver of sensor
48 transmitter of sensor
50 alarm map
52 audible alert generated by processor
54 admit function
56 data edit function
58 transport of a patient function
60 discharge function
62 band adjust function
64 data entry screen for admit function
66 patients last name entry box
68 patients first name entry box
70 patients room entry box
72 patient sex entry box
74 patient remarks entry box
76 tag identification number entry box
77 data entry screen for transport function
78 transport start time entry box
80 transport origin entry box
82 transport destination entry box
84 return time data entry box

85 screen indicating detection of an alarm situation
86 an alarm icon
88 box indicating the tag number causing generation of the alarm
90 box including description of event occurring when alarm situation determined
92 box including a description of the reason for generation of the alarm signal
94 box including the name of the patient
96 box including the room number of the patient
98 discharge icon on main menu screen
100 up/down arrows on side of screen
102 scroll bar on side of screen
103 discharge screen
104 box including information on date and time of last data entry
106 date and time the information was entered
108 tag icon
110 tag change screen
112 up/down arrows on side of screen
114 scroll bar on side of screen
116 enable box on tag change screen
118 change band box on tag change screen
120 floor plan of facility
122 alarm indication of infant at door on floor plan
124 alarm indication of tag cut on floor plan

DETAILED DESCRIPTION OF THE PREFERRED EMBODIMENT

Turning now descriptively to the drawings, in which similar reference characters denote similar elements throughout the several views, FIGS. 1 through 11 illustrate the patient monitoring and alarm system of the present invention indicated generally by the numeral 10.

The patient monitoring and alarm system 10 is installed within a desired facility 12 and includes a central monitoring station 14, a plurality of sensors 16 strategically positioned around the facility and a plurality of tags 18 releasably connected to persons or objects 20 desired to be monitored. The sensors 16 monitor movement of the tags 18 as the persons or objects 20 to which the tags are attached move throughout the facility 12. The sensors 16 receive signals from each tag 18 positioned within a predetermined distance therefrom. The tags 18 repeatedly transmit the identification signals so they may be constantly monitored by the sensors 16 positioned around the facility 12. The sensors 16 transmit signals to the central monitoring station 14 indicating which tags 18 are within a predetermined distance therefrom.

Figure 1:
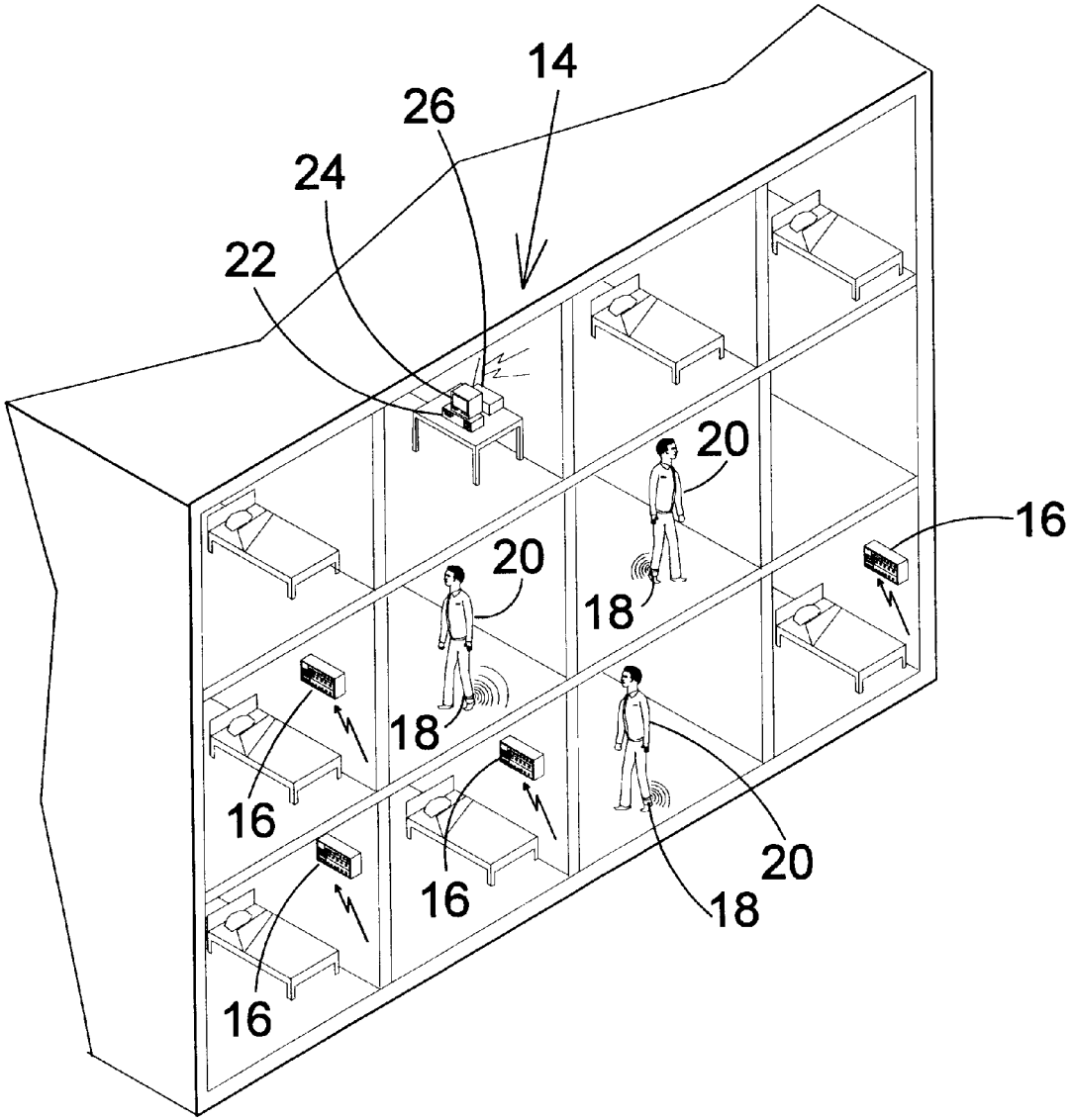
FIG. 1 is a perspective view showing the inside of a health care facility including the patient monitoring and alarm system of the present invention.
Figure 1A:
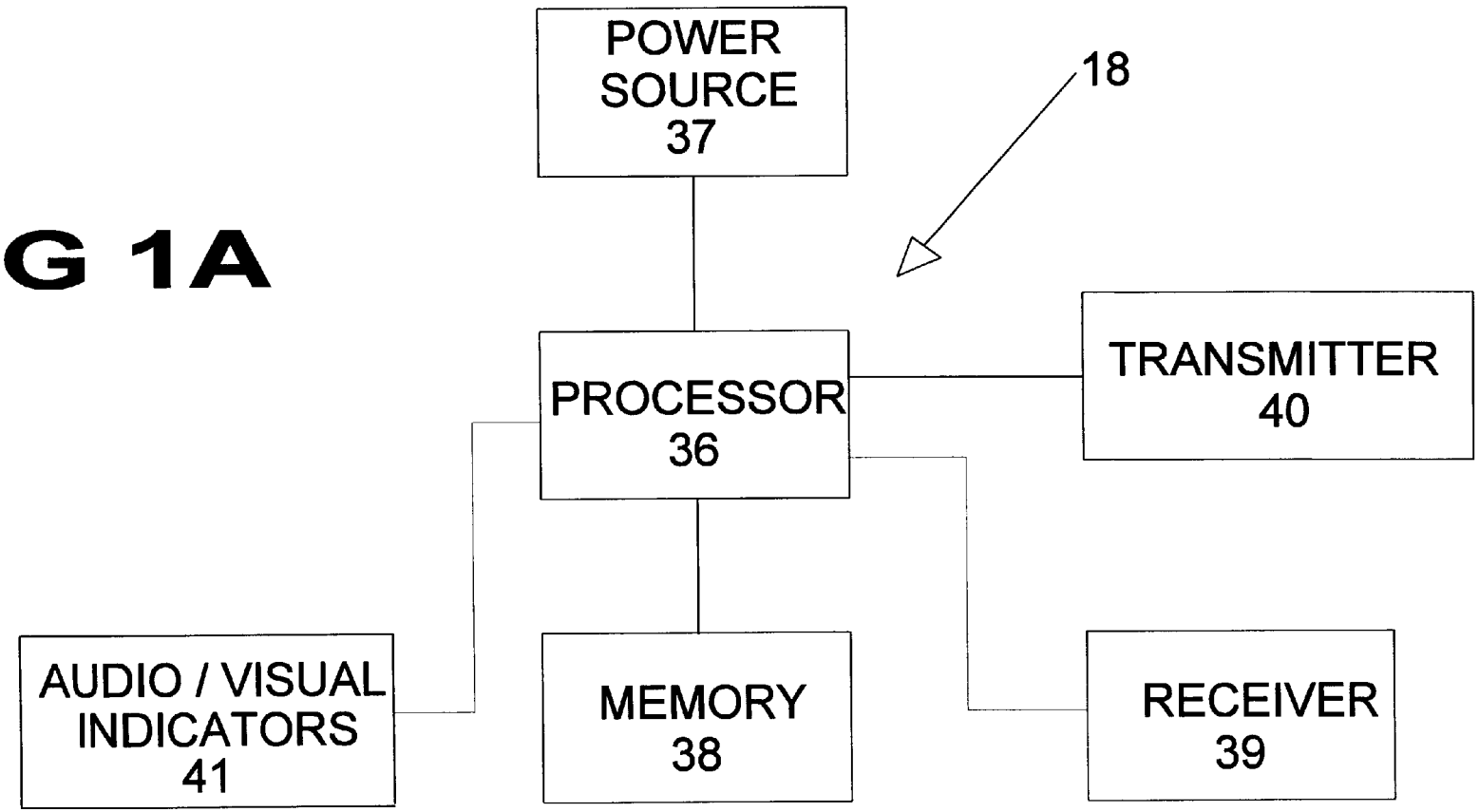
FIG. 1A is a block diagram of one of the plurality of tags for use with the patient monitoring and alarm system of the present invention.

Each tag 18, as can be seen from FIG. 1A, includes a processor 34, a memory 36, an internal power source 37 and a transmitter 38. The memory 36 is connected to the processor 34 and stores an identification code associated with its respective tag 18. The processor 34 causes the transmitter 38 to repeatedly transmit a signal including the identification code at regularly timed intervals. The transmitted signal is preferably a radio frequency signal at a predetermined frequency which is able to be received by each of the plurality of sensors 16. A power source 37 is also provided and connected to the processor 36 for supplying the elements of the tag 18 with an operating power. The tag 18 is hypo-allergenic, small, lightweight, water-resistant, and easily sterilized for reuse. The tag 18 also includes a selective locking latch for releasably securing the tag 18 to a person or object to be monitored. In addition, the tags 18 can have a receiver 39 and additional components such as audio and visual indicators 41 which can interact with the strategically placed sensors 16 to instantly alert the tagged patient, care taker, or security personnel positioned in the vicinity of a tag 18 that a patient to which the tag 18 is attached is leaving a predetermined permissible area. If the tag is cut or unlocked without prior authorization, the transmitter 40 will transmit a signal to the central monitoring station 14 indicating the tag has been cut or removed. Receipt of this signal by the central monitoring station 14 will cause an alarm signal to be generated.

Figure 1B:
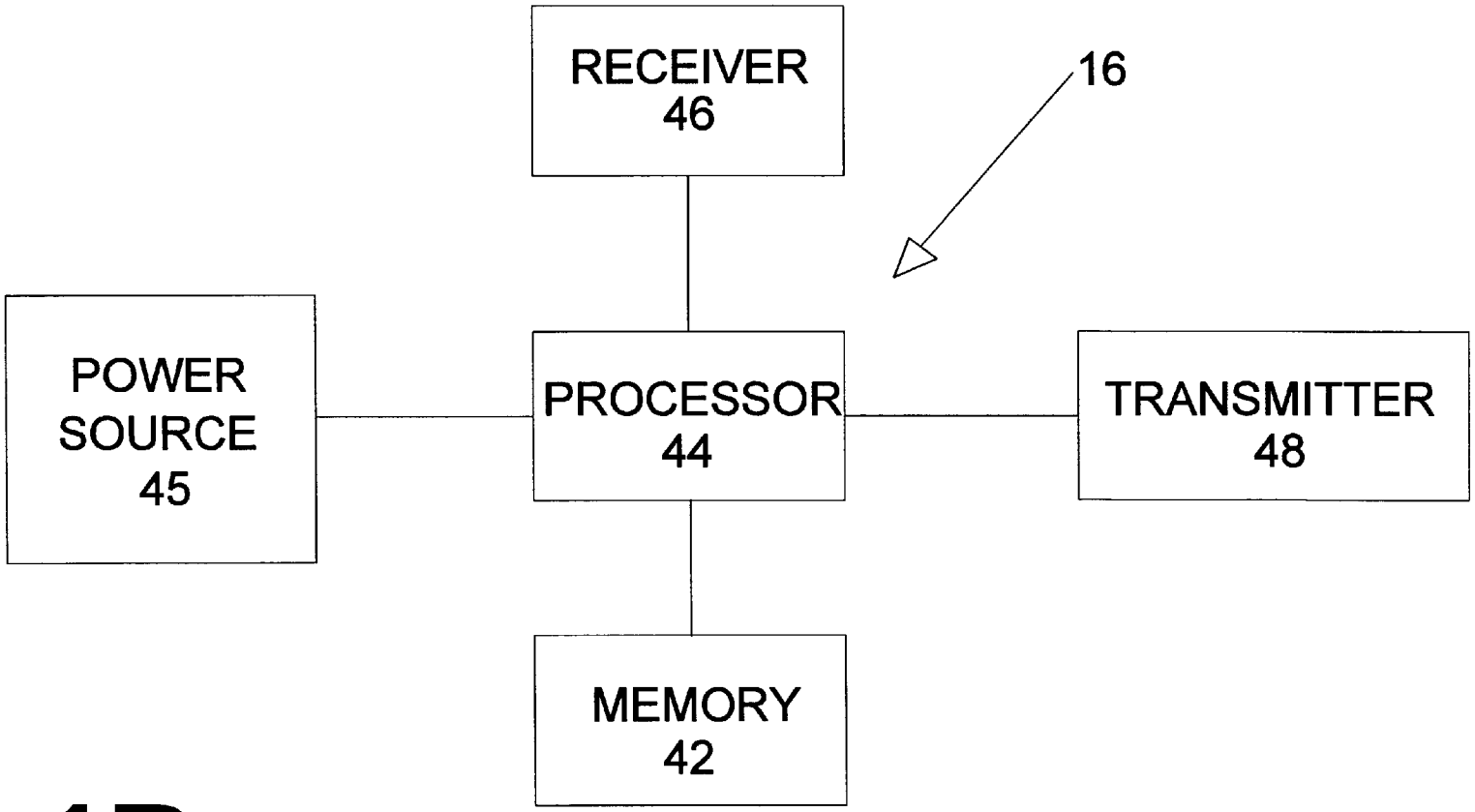
FIG. 1B is a block diagram of one of the plurality of sensors for use with the patient monitoring and alarm system of the present invention.

Each of the plurality of sensors 16, as illustrated in FIG. 1B, includes a memory 42 for storing an identification code associated therewith, a processor 44, a power source 45, a receiver 46 and a transmitter 48. The memory 42 stores an identification code for the sensor 16 thereby allowing the central monitoring station 12 to identify the particular sensor 16 when a signal is received therefrom. The power source 45 is connected to the processor 44 of the sensor 16 for supplying operating power thereto. The power source 45 may be an internal battery or a connection to an external power supply. The receiver 46 is tuned to receive the signals transmitted by the tags 18. As the tag signals are preferably radio frequency signals, the receiver 46 is preferably adapted for receiving radio frequency signals. However, any type of receiver may be used as long as it is able to receive the signals transmitted by the transmitter 40 of the tags 18. The memory 42 is connected to the processor 40. The processor 40 acts to retrieve the identification code from the memory 42 at regular predetermined timed intervals and causes the transmitter 48 to transmit a signal including the identification code of the sensor 16 and the identification code of each tag 18 for which a signal has been received to the central monitoring station 14. The strategically placed sensors 16 communicate with the central monitoring station 14 by either hardwire or wireless transmission methods. The identification code of each sensor 16 is transmitted along with the received identifying code of the tags 18 within a predefined area from the sensor 16 thereby enabling the central monitoring station 14 to ascertain the location of any tag 18 at regular predetermined intervals of time. Further the strategically placed sensors 16 can be selectively repositioned to conform to special needs. Such special needs allows for adjustment of the positioning of the sensors 16 to allow a patient access to a designated area without the need to reprogram the central monitoring station 14 or triggering an alarm by the central monitoring station 14.

Figure 1C:
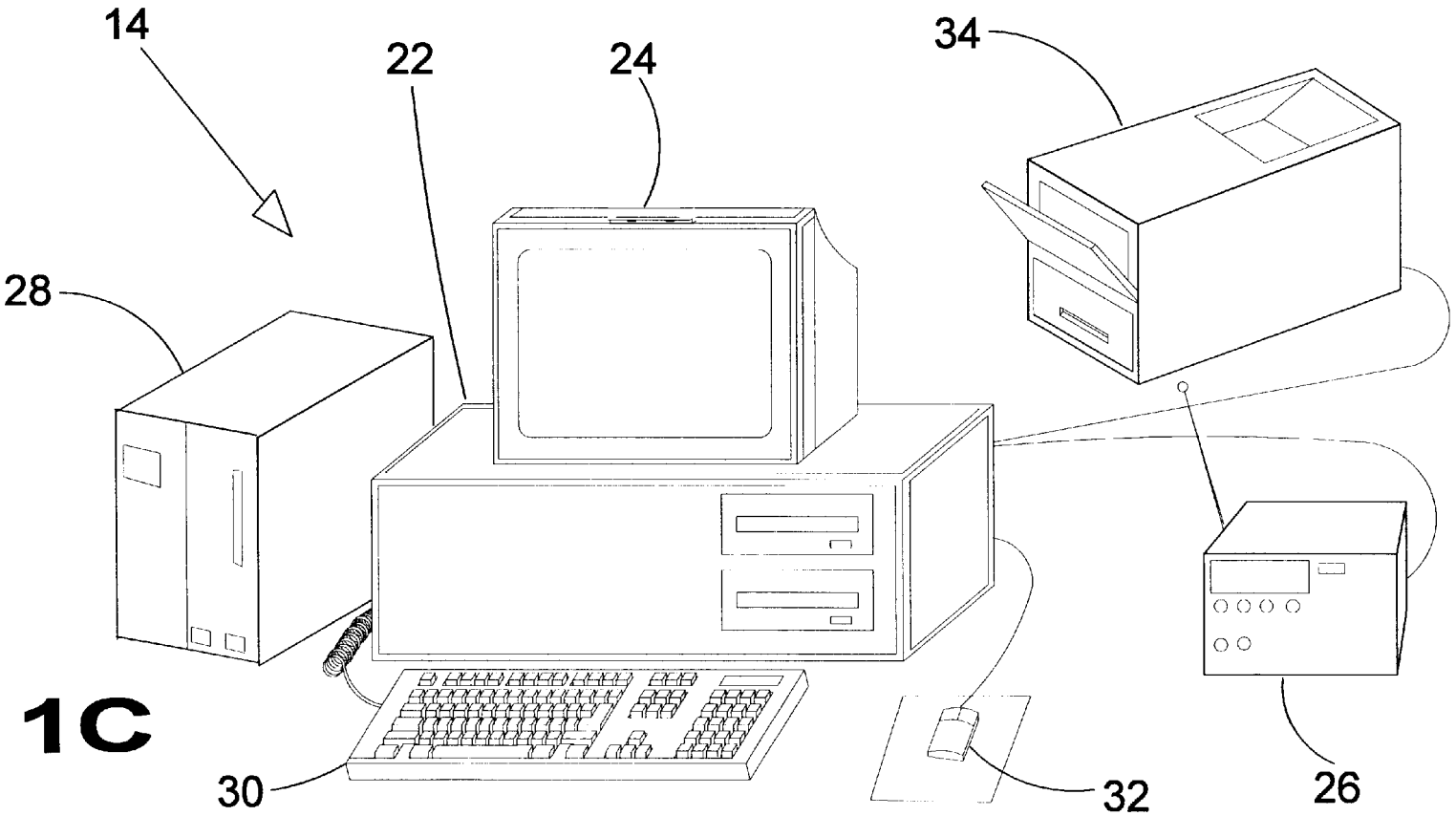
FIG. 1C is a perspective view of the central monitoring station of the patient monitoring and alarm system of the present invention.

The central monitoring station 14 is illustrated in FIG. 1C and is able to receive the signals transmitted by each of the plurality of sensors 16 via the transmitter/receiver 26. The central monitoring station 14 includes a central processor 22 and monitor 24. The processor 22 is connected to a transmitter/receiver 26 which receives signals from and transmits signals to the plurality of sensors 16 and tags 18. The transmitter/receiver 26 receives the identification signals from each sensor 16 and passes the signals to the processor 22 of the central monitoring station 14. The processor 22 analyzes the received signals to determine which sensor 16 transmitted the signal, the location of the sensor 16 and the tags 18 positioned near the sensor 16. Based upon this information the processor 22 is able to determine if a tag 18 is positioned within its predetermined allowed area or has wandered into a restricted area.

As can be seen from FIG. 1C, the central monitoring station 14 includes the central processor 22, a monitor 24, the transmitter/receiver 26, a tag/barcode reader 28, a keyboard 30, a mouse 32 and a printer 34. The central processor 22 is provided with a memory for storing information which is input thereto. The memory of the processor 22 of the central monitoring station 14 stores all data concerning each tag 18 to be monitored by the patient monitoring and alarm system 10 and each sensor 16. This data includes identification information for each tag 18 and sensor 16 and a predetermined area defining the limits of travel permitted for each tag 18. Also stored in the memory of the processor 22 of the central monitoring system 14 are any particular conditions for individual tags 18 and sensors 16 which need to be taken into account when processing the received signals as will be discussed hereinafter.

The identification number of each tag 18 may be read into the processor 22 for storage in the memory by the tag/barcode reader 28 by scanning a code, e.g. a bar code, placed on each tag 18. The patient monitoring and alarm system 10 also processes data signals received by the transmitter/receiver 26 from each of the plurality of sensors 16 and tags 18 in the central processor 22. The signals include information regarding the location of each tag 18 to determine if each tag 18 and thus person or object 20 to which each tag 18 is connected is located in a permissible area or has wandered outside the permitted area. The keyboard 30 and mouse 32 are used to manually input data to the processor 22 as will be discussed hereinafter. The monitor 24 displays information concerning the location of the sensors 16 within the facility and displays data entry screens for aiding the user in inputting data to the central processor 22 and editing data stored in the central processor 22. Software stored in the memory creates data input screens to be displayed by the monitor 24 to thereby create a user friendly system in which a person monitoring the tag locations can readily input and edit information in the system and monitor activities within the facility 12. A printer 34 is connected to the central processor 22 for providing a hard copy of information processed by the central processor 22 regarding the locations of each of the tags 18 and whether any of the tags 18 have entered an area without authorization or traveled outside a predetermined path. In addition, the central monitoring system 14 has security access measures whereby the tag/barcode reader 28 reads ID badges issued to authorized personnel and/or a password needs to be entered by the authorized personnel in order to gain access to certain patient information and tag related functions.

Figure 2:
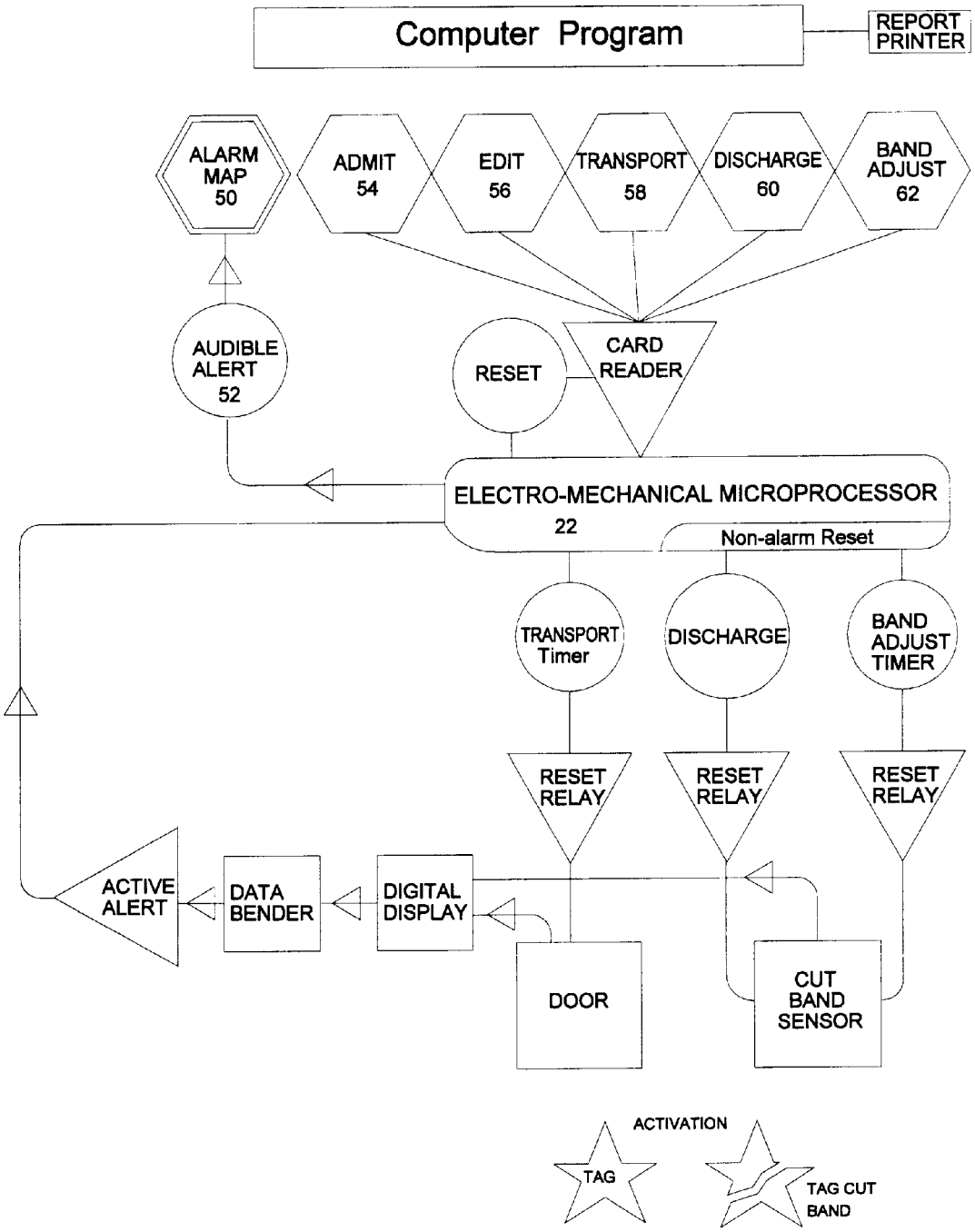
FIG. 2 is a flow chart showing the functions of the patient monitoring and alarm system of the present invention.

The processor 22 is preprogrammed with a patient monitoring software program which is able to process the information received from the sensors 16 regarding sensor location and information concerning which tags 18 are positioned within an area monitored by each individual sensor 16. The flow chart illustrated in FIG. 2 shows the operation of the central processing station 14 for monitoring the location of the tags 18 within the facility. The central monitoring station 14 monitors the location of the tags 18 in accordance with a stored interactive software program wherein information and data concerning each tag 18 is entered by a user and the software program monitors each tag 18 in accordance with the input information and data received from the plurality of sensors 16. The software also provides the central processor 22 with a collection of graphical user interface screens to be displayed on the monitor 24 thereby providing user friendly means for assigning tags to patients, displaying data entered, querying data entered, modifying data entered, archiving data entered and reporting data entered.

Further the central monitoring station 14 includes the transmitter/receiver 26 for receiving sensor transmissions which are selectively displayed on the monitor 24 in an illustrative floor plan or floor plans. The floor plan displays the plurality of sensor devices which perform the reporting function of the central monitoring system and the position of the tags relative to the sensors. In addition the central monitoring system 14 may include a plurality of remote keypads whereupon authorized personnel can key in their authorization code while transporting a patient having a tag attached thereto from one location to another.

Each tag 18 is programmed with a specific identification number and assigned to a particular person or object 20. The software controlling the operation of the central processor 22 includes an alarm map 50 depicting a floor plan or floor plans of the facility in which the patient monitoring system 10 is installed and displays the position of the plurality of sensors within the floor plan and inserts information received from the plurality of sensors concerning the location of each of the tags 18. The alarm map 50 will automatically be displayed by the monitor 24 when the processor 22 determines that a tag has moved outside of a predetermined permissible area for the tag 18 or that a tag has been cut or damaged in some manner based upon analysis of the signals received from the sensors 16. The processor 22 will generate an audible alert 52 and display the position of the tag causing the audible alert 52 on the floor plan. An illustration of the alarm map 50 upon detection of an audible alert by the processor 22 is illustrated in FIGS. 10 and 11.

Information concerning the identification number and person or object 20 to which the tag 18 is associated is entered into the central processor 22 using the admit function 54 shown in the figure. Upon accessing the admit function 54 using the interactive display screen on the monitor 24, the tag identification number is read by the barcode reader 28 for storage in the central processor 22 and pertinent information regarding the person or object 20 is entered for storage in the central processor 22 via the keyboard 30. Accessing the admit function 54 causes the central processor 22 to generate an electronic form which is displayed on the monitor 24 providing means for entering patients into the monitoring system, the form displayed upon accessing the admit function is shown in FIG. 3 and will be described hereinafter.

Figure 3:
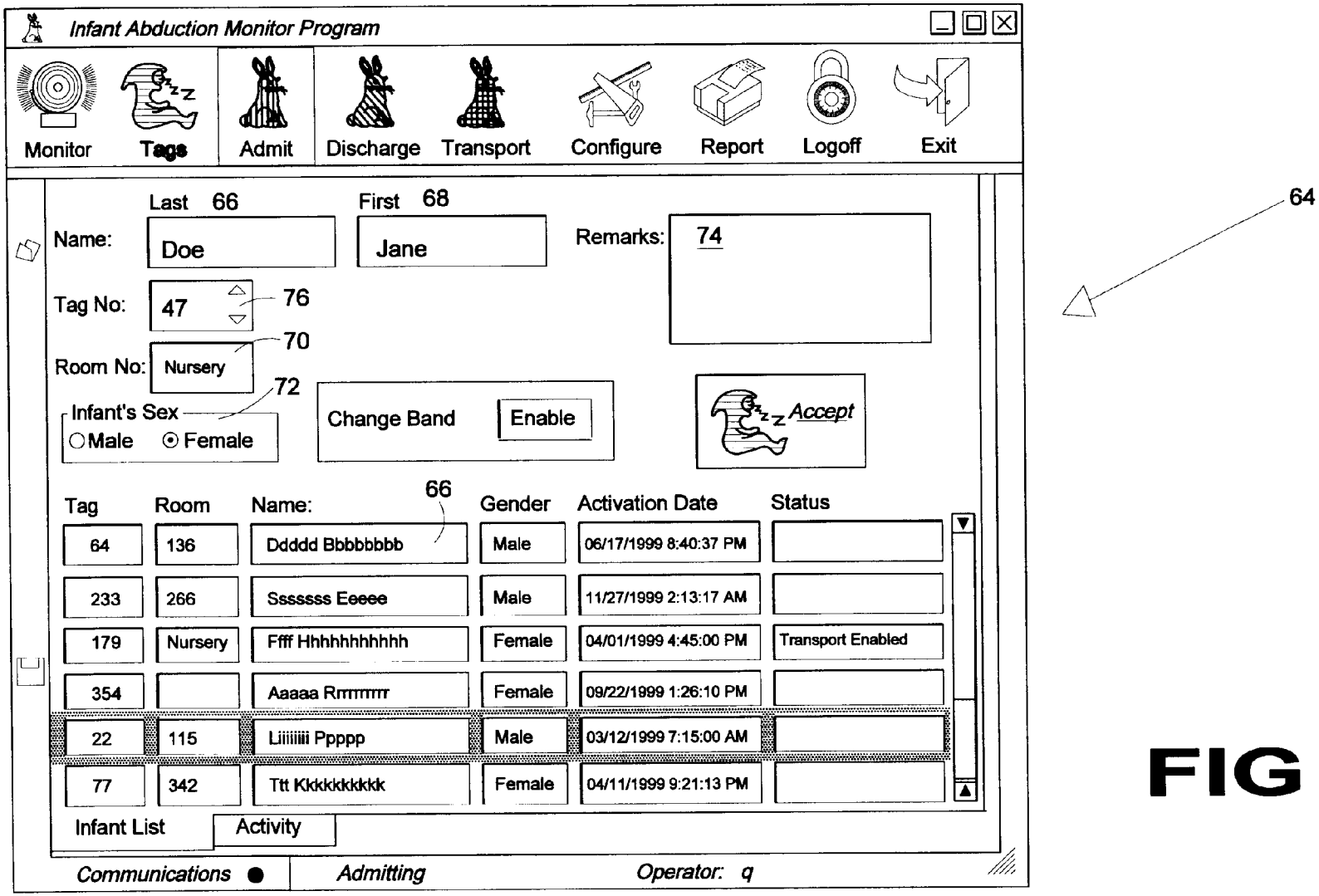
FIG. 3 is a diagrammatic view of the graphical user interface used to enter a patient into the patient monitoring and alarm system of the present invention for assigning a tag to the patient.

FIG. 3 illustrates the electronic form 64 generated upon entering the admit function 60. The form 64 includes designated points of entry for the patients last name 66, patients first name 68, patients room number 70, patients sex 72, patient remarks 74 and patients assigned tag number 76. The information is entered via the keyboard 30 and electronically recorded and stored in the memory of the central processor 22 for future reference by the various functions of the monitoring system. Entry of this data is performed by moving a cursor around the screen to the desired box and typing in the requisite information. Movement from box to box can be performed by moving a cursor arrow with the mouse 32 or using the tab key on the keyboard 30 as in most conventional data entry systems. Upon entry of information into the form 64, the information will be added to a list of admitted patients shown below the data entry portion of the form 64.

Figure 4:
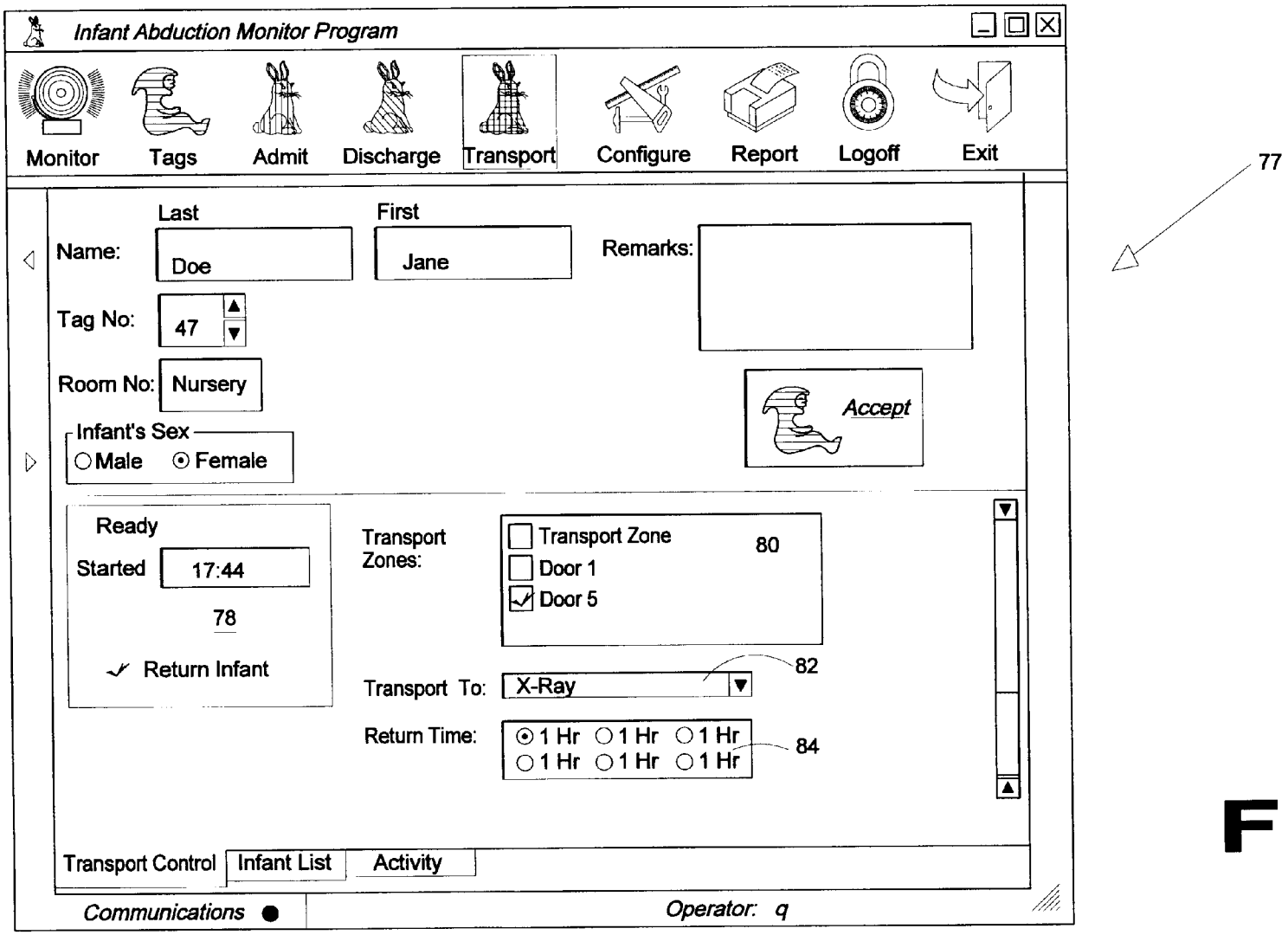
FIG. 4 is an illustrative view of the graphical user interface for the patient monitoring and alarm system of the present invention used to discharge a patient.
Figure 5:
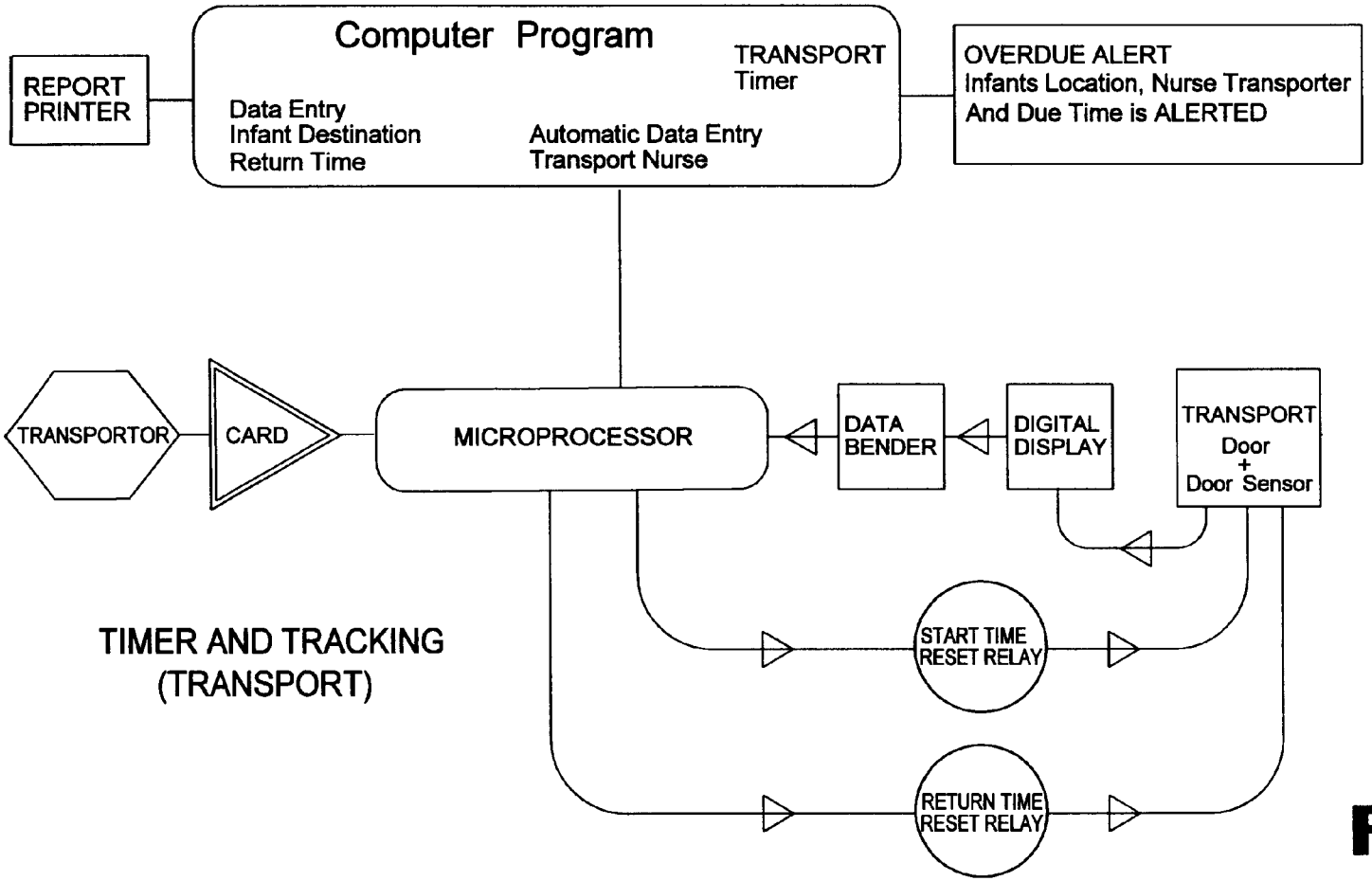
FIG. 5 is a flowchart of the "transport" function initiated through an electronic form displayed on a monitor for the patient monitoring and alarm system of the present invention to request authorization from personnel in order to move a patient from one location to another within a specified period of time.

When it is desired to move a patient or infant to which a tag is connected, the permissible area in which the tag may be located must be edited. Editing of the permissible area for transport of a tag is performed by entering a transport function 58 from the main menu generated by the central processor 22. Entering of the transport function 58 causes the central processor 22 to generate an electronic form 77 to be displayed on the monitor 24. This form 77 allows authorized personnel to enter a route along which the patient or infant will be moved and thereby allow movement of the patient from one location to another within a specified period of time. An illustration of the electronic form 77 used to edit the allowable location for a tag to be transported and sets forth a route which the tag must follow is shown in FIG. 4. A flow chart of the operation of transporting a patient or infant to which a tag 18 is attached is illustrated in FIG. 5. When the tag 18 deviates from the course set forth when editing the information on the display associated with the transport function or takes more than the allotted time period to be transported to a desired area, an alarm screen is generated by the microprocessor, an exemplary alarm screen generated due to this condition is illustrated in FIG. 5A.

FIG. 4 illustrates the form 77 generated when it is desired to edit the information regarding a tag 18 in order to transport a patient or infant to a different location within the facility 12. This form provides data input sections for time at which transport will start 76, the transport zone from which the patient will be leaving 78, the location to which the patient will be transported 80 and the time required for transport 82 (when the patient will be returned to the original location). Upon entering this information, the patient will be allowed to exit the original permissible area at the start time and for a period of time ending upon passage of the return time without triggering generation of an audible alert signal 52 by the central processor 22. A path for transport will be set up by the monitoring system and will be monitored to determine if the patient has deviated from the path. Should the central processor 22 determine that the patient has deviated from the path, the processor 22 will generate an audible alert signal 52 indicating such.

A flow chart illustrating the procedure for editing the information within the system to allow for transport of a patient is illustrated in FIG. 5. The personnel making the request or transporting the patient must enter identification information to the system. This identification information will be verified against an authorized personnel database to determine that the transporter has authorization to transport the patient. The identification information may be entered by passing an identification card through the card reader 28 or entering the information on the keyboard 30. Upon receiving authorization, the transporter will select the transport function 58 from the main menu screen and enter the transport information on the transport data entry screen 77. The monitoring system will then monitor the movement of the patient to which the tag is attached through signals received from the plurality of sensors 16 and by verifying and logging all sensor data. The processor 22 will record the progress of the patient through the facility between the beginning and ending destination points of the transport. The logged information will be provided to the printer for producing a hard copy log of the transport of the patient. Should the attendant and or patient deviate from their predetermined location or path of egress or the allocated time has elapsed, an alarm warning function will be initiated.

Figure 5A:
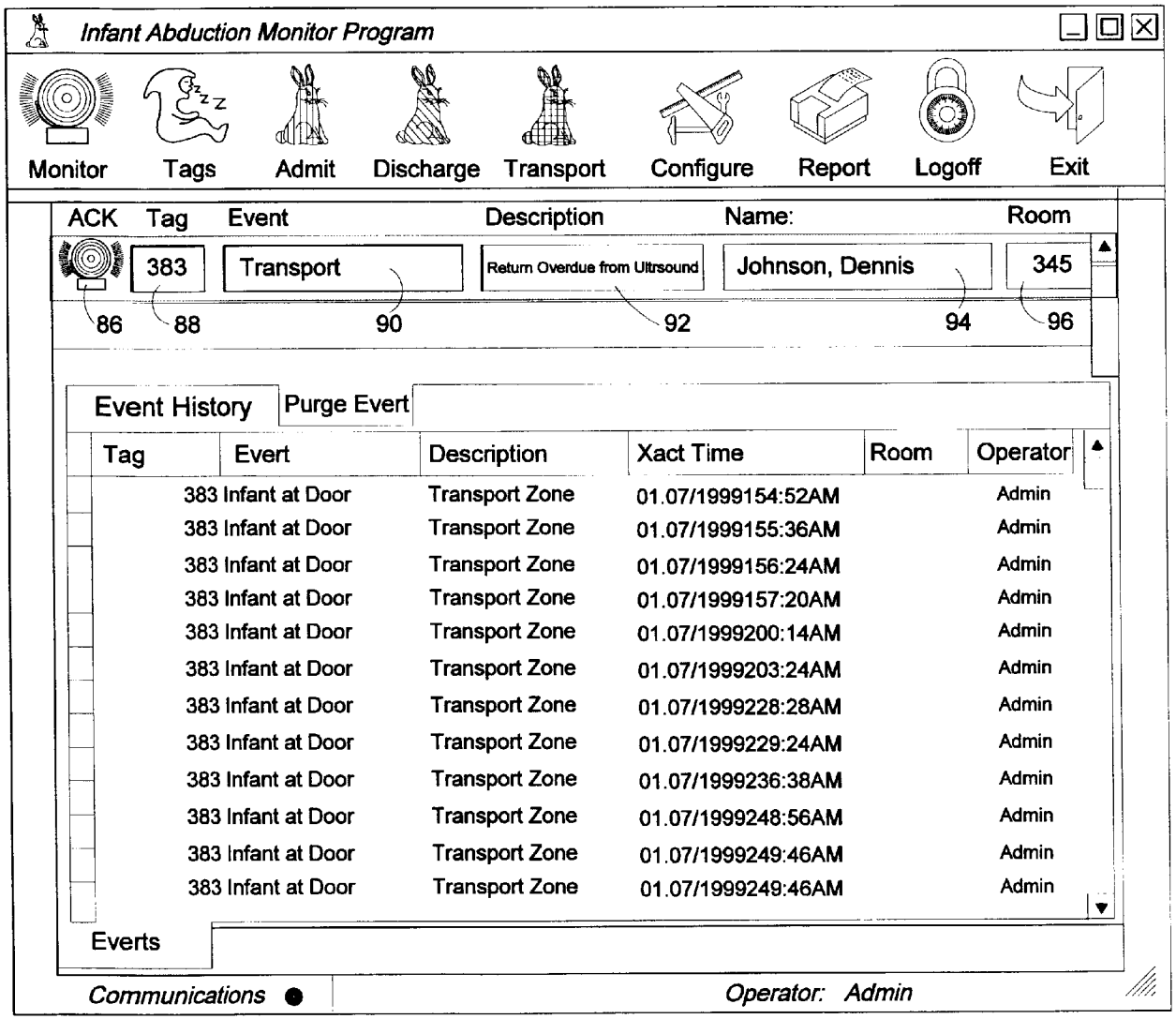
FIG. 5A illustrates a display provided by the computer of the patient monitoring and alarm system providing an alert that transport of a patient is overdue.

A display screen as illustrated in FIG. 5A will be generated when the allocated time for transport has elapsed. As can be seen from this figure, an alarm icon 86 is generated on the screen along with a box 88 indicating the tag number causing generation of the alarm, a box 90 including a description of the event occurring when the alarm situation was determined, a box 92 including a description of the reason for generation of the alarm signal, a box 94 including the name of the patient and a box 96 including the room number of the patient. An audible alarm is also generated at the central monitoring station 14 to alert any personnel in the vicinity as to the alarm situation. A signal may also be transmitted to the tag 18 causing the generation of the alarm signal in order to trigger any audible and visual alarm thereon.

Figure 6:
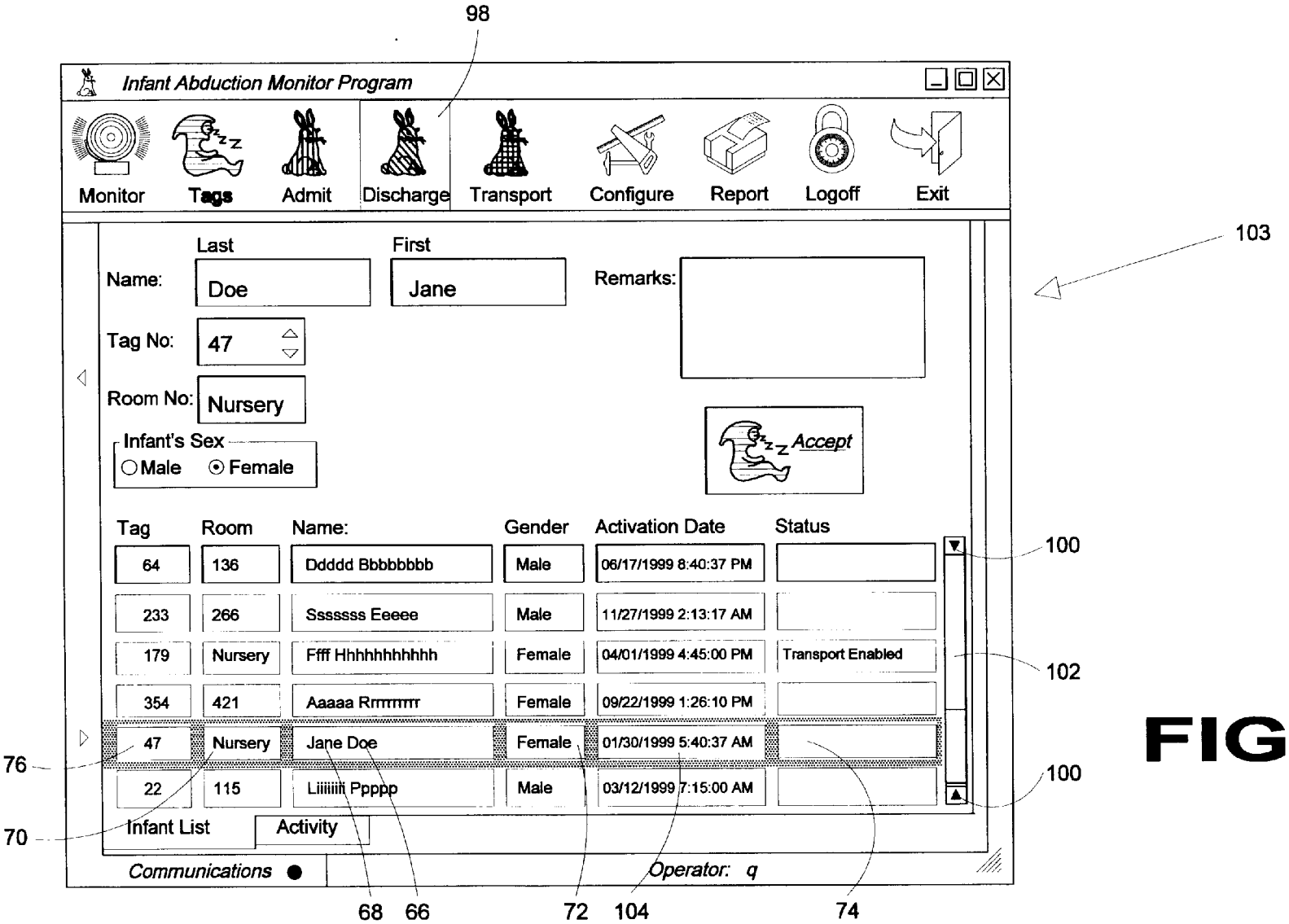
FIG. 6 is an illustrative view of the graphical user interface used by the patient monitoring and alarm system of the present invention to discharge a patient.

When it is desired to discharge a patient or infant to which a tag 18 is connected, the information regarding the tag 18 must be removed from the system. Removing of this information from the system is performed by entering a discharge function 60 from the main menu generated by the central processor 22. Entering the discharge function 60 generates an electronic form allowing authorized personnel to remove a patient from the monitoring system. An exemplary form generated by the central processor 22 upon entering the discharge function 60 is illustrated in FIG. 6. A flow chart illustrating the operation of removing the information from the monitoring system is illustrated in FIG. 7.

Figure 7:
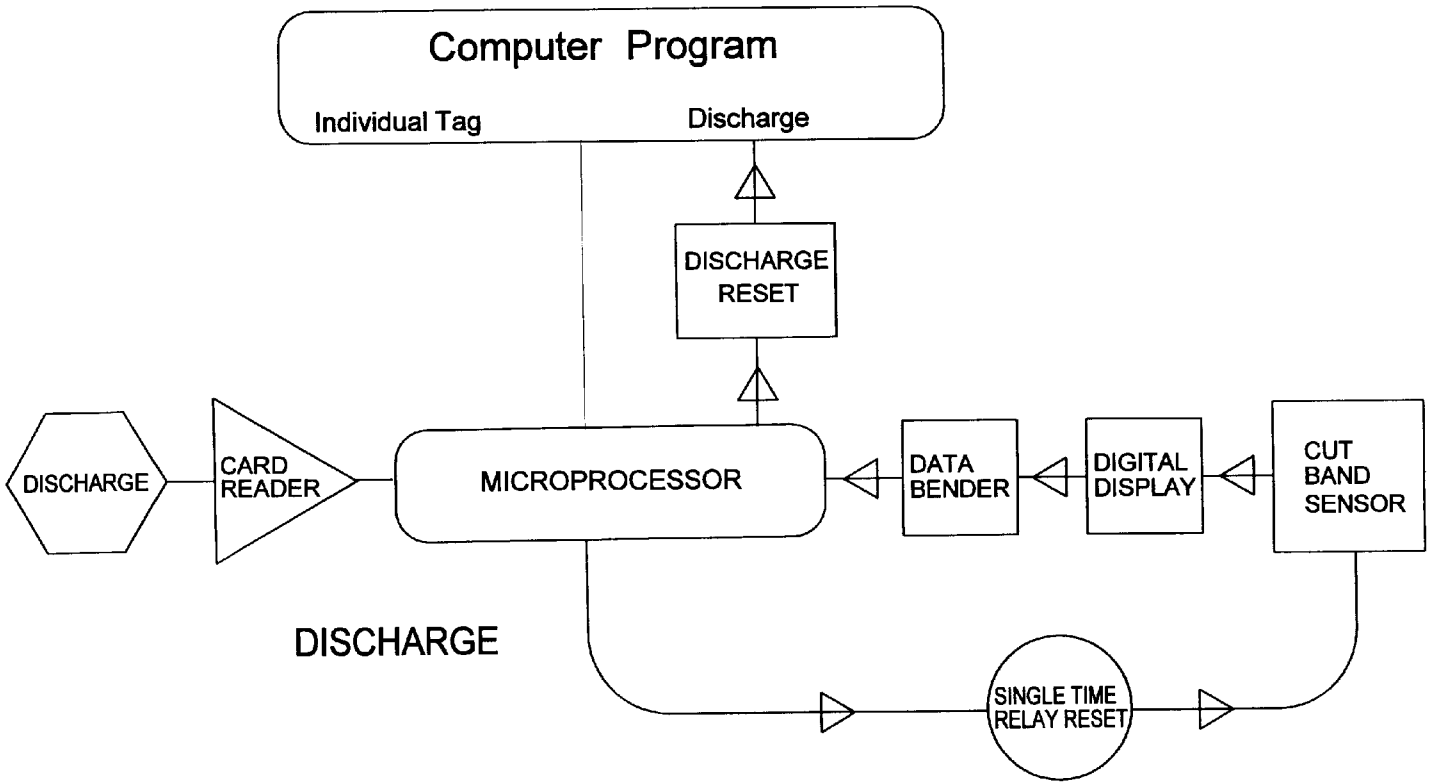
FIG. 7 is a flowchart of the "discharge" function initiated through an electronic form displayed on a monitor of the patient monitoring and alarm system of the present invention for requesting authorization from personnel in order to discharge a patient from the monitoring system.

In order to enter the discharge function 60 as illustrated in the flow chart of FIG. 7, any authorized user will move a pointer on the main menu screen using the mouse 32 to the discharge icon 98 and select the icon by pressing a button on the mouse 32. The authorized personnel is then instructed to enter identification information by either passing an ID card through the card reader 28 or entering a password using the keyboard 30. Once the system has verified the identification information, the previously entered data comprising the patients last name 66, patients first name 68, patients room number 70, patients sex 72, patient remarks 74 and patients assigned tag number 76 will be displayed along with the date and time the information was entered 104 will be displayed on the discharge screen 103 shown in FIG. 6. The user will then move the arrow icon with the mouse 32 to the arrows 100 located on the left side bar 102 of the screen 103 and press the button on the mouse to scroll the data until the desired patient information has been located. The authorized personnel will select the information for the desired patient by moving the arrow to point to the information and pressing the button on the mouse to select the information. The user will then move the pointing device to the accept icon and press the button on the mouse thereby selecting the desired patient information. This information will then be inserted at a top portion of the screen wherein any authorized personnel can edit the information by simply moving the icon into the desired box and typing in new information.

Figure 8:
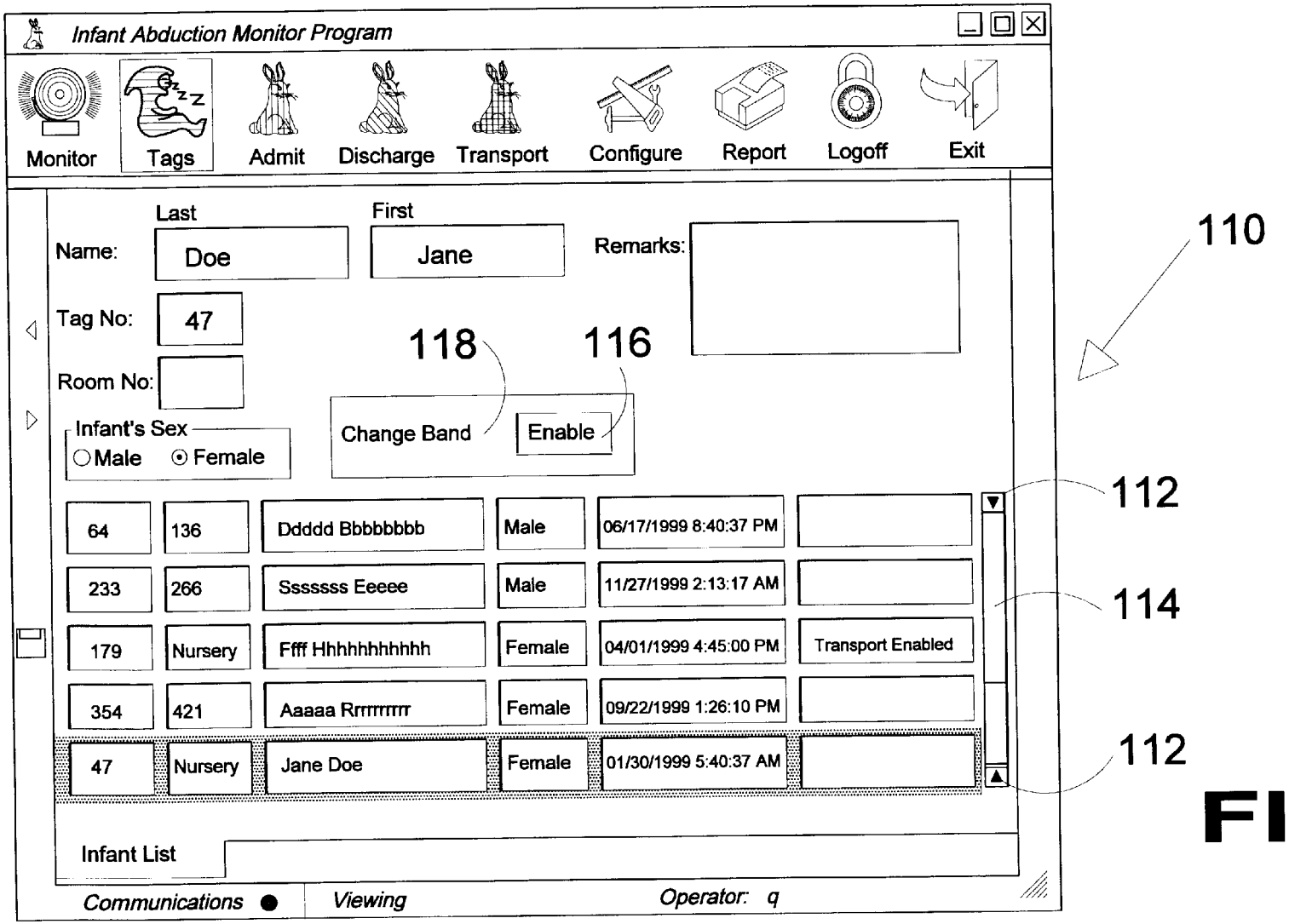
FIG. 8 is an illustrative view of the graphical user interface of the patient monitoring and alarm system of the present invention used to adjust the band.
Figure 9:
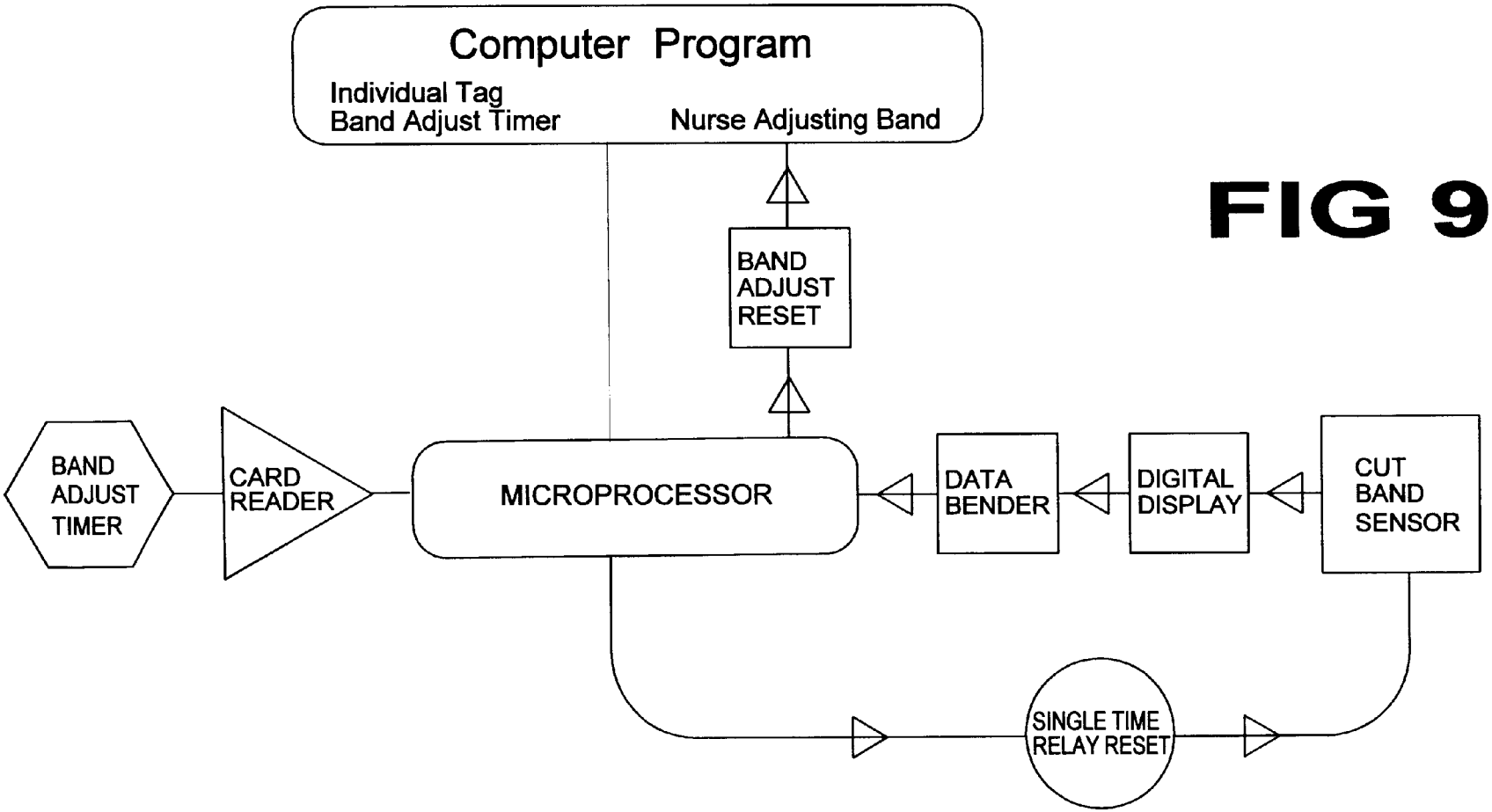
FIG. 9 is a flowchart of the "adjust band" function initiated through an electronic form displayed on a monitor of the patient monitoring and alarm system of the present invention for requesting authorization from personnel in order to disable the alarm function of the tag for adjustment.

When it is desired to adjust the tag 18 on a patient or infant to which the tag 18 is connected, the information concerning the tag 18 must be edited to prevent the processor 22 from generating an audible alert thereby allowing the tag to be unlocked and adjusted. Temporary removal of a tag 18 without generation of an audible alarm signal being generated is performed by entering a band adjust function 62 from the main menu generated by the central processor 22. Entering the band adjust function 62 will cause a pause in the monitoring of the tag 18 for a predetermined period of time. The authorized user will enter the band adjust function 62 by moving the arrow on the monitor screen over to the tag icon 108 and press the key on the mouse 32. Selection of the tag icon 108 causes the central processor 22 to generate an electronic form 110 allowing authorized personnel to delay monitoring of the desired tag 18 for a predetermined period of time by the monitoring system. An exemplary form 110 generated by the central processor 22 upon entering the band adjust function 62 is illustrated in FIG. 8. A flow chart illustrating the operation of removing or adjusting a tag 18 is illustrated in FIG. 9 and is described below with reference to the band adjust screen form 110 shown in FIG. 8.

When it is desired to adjust or remove a tag 18 from its connection to a patient, an authorized user of the system must enter the band adjust function 62. The authorized user making the request is instructed to pass their ID badge through the card reader or enter a password on the keyboard 32 which will log and verify the request for future reporting needs while checking the validity of the identification information. Upon verification of the identification information, the tag adjust screen form 110 will be generated by the central processor 22 and displayed on the monitor 24. The user will then move the arrow icon with the mouse 32 to the arrows 112 located on the left side bar 114 of the screen 110 and press the button on the mouse to scroll the data until the desired patient information has been located. The authorized personnel will move the pointing device to point to the desired information and press the button on the mouse 32 to select the desired patient information. This information will then be inserted at a top portion of the screen. Upon moving the arrow to point to the enable section 116 of the change band box 118 the button on the mouse 32 is pressed to enable the change band function. The selected patient information will be moved to historical data files and the tag 18 will be inhibited from initiating an alarm function for a predetermined period of time providing means for the attendant to remove the tag from the patient. This allows for removing or adjusting the tag 18 on a patient for a predetermined period of time before an audible alert signal will be generated by the central processor 22.

FIGS. 10 and 11 illustrate a floor plan 120 of the facility 12. In FIG. 10, an instance where an alarm situation has been detected is shown. When the alarm situation is detected by the central processor 22, the alarm icon is displayed on the screen 120 and the event box 90 indicates that an infant has moved too close to a doorway. The sensor 16 adjacent the doorway had sent a signal indicating a tag bad moved into the area therearound causing the alarm situation. The alarm is further indicated by displaying the location 122 of the alarm situation in the floor plan 120. An audible alarm can also be generated at the central monitoring station 14 and the transmitter 26 can also transmit a signal to the tag 18 which has been detected by the sensor 16 as being too close to the doorway causing audible and visual alarms to be generated by the tag 18. This will alert anyone in the vicinity of the tag 18 that the tag 18 has moved outside its predetermined allowed area.

FIG. 11 illustrates an alarm situation in which the microprocessor has detected a signal from a tag 18 indicating the tag 18 has been cut. When the alarm situation is detected by the central processor 22, the alarm icon is displayed on the screen 120 and the event box 90 indicates that a tag has been cut. The alarm situation is further indicated by displaying the location 124 of the alarm situation in the floor plan 120. An audible alarm can also be generated at the central monitoring station 14 and the transmitter 26 can also transmit a signal to the tag 18 which sent the tag cut signal to the processor 22 causing audible and visual alarms to be generated by the tag 18. This will alert anyone in the vicinity of the tag 18 that the tag 18 has moved outside its predetermined allowed area, All of the aforementioned function requests are subjected to a security check of the individual making the request. The individual having an ID badge passes the badge through a card reader 28 which verifies the users request against a database of authorized personnel and logs the request for future reporting requirements. The transport discharge and band adjust functions inhibit the tag or monitoring system from engaging the alarm for a predetermined period of time. The discharge and band adjust functions terminate the alarm function once the tag is unlocked for a predetermined period of time. The transport function disables the alarm function as long as the allocated time before returning to the designated area has not been exceeded and the patient passes through those sensor area designated by the authorized attendant prior to removal from the patient's designated area. Should the attendant deviate from the predetermined destination or the allocated time has been exceeded then an alarm warning function will be initiated and warning display on the monitor screen.

The operation of the patient monitoring and alarm system 10 will now be described with reference to the figures. In operation, the patient monitoring and alarm system 10 is installed in a facility by strategically positioning the sensors 16 at different positions throughout the facility and the central monitoring station is set up at a desired location. The transmitter/receiver 26 is connected to the central processor 22 for transmitting signals in response to a command from the processor 22 and receiving signals from the sensors 16 and tags 18. The keyboard 30, mouse 32 and card reader 28 are connected to the processor 22 for inputting data thereto. The printer 34 is connected to the processor 22 for printing a hard copy of logs recorded by the processor concerning movement of the tags 18. Once the central monitoring station is set up, the monitor 24 will show a main menu screen which provides access to any function for entering and editing data within the processor 22. The patient monitoring and alarm system 10 is now ready to begin monitoring the facility 12.

In order to input information concerning a patient and assign a tag to the patient, the admit function is selected from the main menu. The user of the system will then scan a tag to be assigned tot he patient using the card reader 28 and the user will then input information concerning the patient into the spaces provided including the room number. This process may be repeated for each patient to be entered into the system. Preferably the patient will remain within their room and thus the processor will determine when the patient approaches the sensor located in the doorway of their room. Upon determining such, the processor 22 will generate an audible alarm at the central monitoring station 14 and at the tag 18.

If it is desired to edit user information, the user will select the edit function on the main menu and then a screen containing information on each patient is displayed on the edit screen. The user will scroll through this information to find the information on the patient whose information needs to be edited and select that information. Using the keyboard 30, the user will then edit the information on the screen concerning that patient.

If it is desired to transport a patient from their room, the transport function will be selected from the main menu. The transport menu screen will then be displayed containing information on each patient. The user will scroll through this information to find the information on the patient who is to be transported and select that information. Using the keyboard 30, the user will then indicate the transport destination and the time period for the transport. The processor will then monitor the path taken by the patient and generate an alarm signal if the patient deviates from the path or if the patient is not returned to their room upon expiration of the entered transport time.

If it is desired to adjust or temporarily remove a tag from a patient then the tag function will be selected from the main menu. The adjust menu screen will then be displayed containing information on each patient. The user will scroll through this information to find the information on the patient whose tag 18 is to be adjusted or temporarily removed and select that information. Using the mouse 32, the user will move the arrow on the screen to the change band enable box and press the mouse button to select the change band enable option. This will cause the processor 22 to stop monitoring the selected tag for a predetermined period of time so the tag may be adjusted. Upon expiration of the time period the processor will generate an alarm signal if the tag is not reattached.

If it is desired to discharge a patient the discharge function is selected from the main menu. The discharge menu screen will then be displayed containing information on each patient. The user will scroll through this information to find the information on the patient who is to be discharged and select that information. Using the keyboard 30 the user will then delete this information from the screen and thus the processor will discontinue monitoring the tag assigned to that patient.

From the above description it can be seen that the patient monitoring and alarm system of the present invention is able to overcome the shortcomings of prior art devices by providing a patient monitoring and alarm system which is able to assign a tag to a patient upon admission to a health care facility and monitor the location of the patient while within the facility and until such time as the patient is discharged from the facility. The patient monitoring and alarm system is thus able to protect patients from abduction by signaling authorized personnel upon detecting the patient is being taken from a designated area, prevent the substitution of identification from one patient to another, as in the case of swapping the tags of newborns and alert authorized personnel when an attempt is being made to disable or remove the tag from a patient. The patient monitoring and alarm system passively monitors a patient using strategically located sensors which will report movement of tagged patients authorized personnel using a plurality of remote sensors which are able to transmit radio frequency signals to a central processing station, the central processing station recording and reporting the movement of a tagged patient within a health care facility to authorized personnel. The patient monitoring and alarm system also includes one or more user-friendly interactive central stations each having a monitor, a keyboard, a card reader, a transmitter, a receiver and a printer for reporting, displaying and editing data through the use of graphical user interfaces and capable of displaying a location of an alarm condition on a floor plan or floor plans of the facility. The patient monitoring and alarm system assigns as tag to a patient for monitoring purposes and generates real time alarms and reports to thereby prevent unauthorized tampering or removal of a tag from the patient. The patient monitoring and alarm system is able to be disengages for a predetermined period of time in order to adjust the tag without causing the alarm signal to be generated and allows movement of a tagged patient from one location to another outside of a predetermined range of motion for a predetermined period of time whereby a return time for the patient is monitored and an alarm signal is generated upon expiration of the predetermined period of time or if the patient deviates from a path to be followed to a predetermined destination. Furthermore, the patient monitoring and alarm system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method of providing a user interface for monitoring tagged objects in a predetermined area, comprising the steps of:

a) entering security information permitting users access to the interface;

b) generating a first menu tool bar having a plurality of icons each representing a respective one of a plurality of functions on a screen for initiating a plurality of functions including at least two of:

i) monitoring a status of alarms on tags;

ii) associating a uniquely identified tag with an individual object;

iii) updating tag information;

iv) updating object identification information; and v) disabling tag monitoring system for a selected tag;

c) initiating a function selected from said first menu toolbar, selection of said function of associating includes the step of generating a data input screen for inputting tag and individual object information;

d) said individual object is a person and the step of generating the data input screen includes generating specific areas for input of information including any combination of a first name of the person, a last name of the person, a room in which the person will be located, a sex of the person, remarks concerning the person and a tag number to be associated with the person;

e) placing the information input to the data input screen into a data base for storing information on all tags and the person associated therewith; and f) selection of said icon representing updating tag information includes the step of generating a display screen including a change band enable icon, wherein selection of said change band enable icon inactivates monitoring of a selected tag for a predetermined period of time.

2. The method of claim 1, wherein said step of entering includes passing an identification tag including a unique barcode identification through a barcode reader.

3. The method of claim 1, wherein said step of entering includes the step of entering an identification code on a keyboard.

4. The method of claim 1, wherein said icon representing the function of monitoring a status is in the form of an alarm bell.

5. The method of claim 1, wherein said icon representing the function of associating is in the form of a rabbit including vertical stripes thereon.

6. The method of claim 5, wherein said icon representing the function of associating includes the word |admit| therebelow.

7. The method of claim 1, wherein said icon representing the function of updating tag information is in the form of a rabbit having horizontal and vertical intersecting lines thereon.

8. The method of claim 7, wherein said icon representing the function of updating tag information includes the word |transport| therebelow.

9. The method of claim 1, wherein said icon representing the function of updating object identification is in the form of a baby sleeping.

10. The method of claim 9, wherein said icon representing the function of updating tag information includes the word |tags| therebelow.

11. The method of claim 1, wherein said plurality of functions further include disassociating a tag from an individual object.

12. The method of claim 11, wherein said toolbar includes an icon thereon representing said function of disassociating.

13. The method of claim 12, wherein said icon representing the function of disassociating is in the form of a rabbit having diagonal lines thereon.

14. The method of claim 1, wherein selection of said icon representing said function of monitoring causes a floor plan of the area being monitored to be displayed on a screen.

15. The method of method of claim 14, further comprising the step of monitoring the predetermined area for alarm situations and indicating a location of an alarm situation on the floor plan upon detection of an alarm situation.

16. The method of claim 1, wherein generating the display screen in response to selection of said icon representing updating tag information further includes the step of displaying a list of all information contained in the database.

17. The method of claim 1, wherein said tool bar further includes an icon representing the function of transporting an object outside the predetermined area.

18. The method of claim 17, wherein said icon representing the function of updating tag information is in the form of a rabbit having horizontal and vertical intersecting lines thereon.

19. The method of claim 18, wherein the icon representing the function of updating tag information includes the word |transport| therebelow.

20. The method of claim 19, wherein selection of the icon representing the function of updating tag information includes the step of generating a display screen including spaces for inputting a time for transport, a location to transport the object to, a location from which the object will be transported and a time period until the object is returned.

21. The method of claim 20, wherein inputting the information in the display screen generated upon selection of the icon representing the function of updating tag information allows the object to be removed from the predetermined area without triggering an alarm.

* * * * *